United States Patent [19]

Laven

[11] 4,124,907

[45] Nov. 14, 1978

[54] SWIMMING POOL, AND COMPONENTS THEREOF

[76] Inventor: Merrill L. Laven, 4 Marion Ave., Albany, N.Y. 12203

[21] Appl. No.: 656,595

[22] Filed: Feb. 9, 1976

Related U.S. Application Data

[63] Continuation-in-part of Ser. No. 428,882, Dec. 27, 1973, Pat. No. 3,938,199.

[51] Int. Cl.[2] ..... E04H 3/16; E04H 3/18; E04C 1/00

[52] U.S. Cl. ..... 4/172.19; 52/169.1; 52/282; 52/288; 52/309.1; 52/780; 52/588

[58] Field of Search ..... 4/172, 172.19, 173; 52/288, 282, 309, 495, 588, 169 R, 169.7, 657; 248/351

[56] References Cited

U.S. PATENT DOCUMENTS

| | | | |
|---|---|---|---|
| 3,016,546 | 1/1962 | Lerner | 4/172.19 |
| 3,100,556 | 8/1963 | DeRidder | 4/172 |
| 3,192,538 | 7/1965 | Walter | 4/172.19 |
| 3,298,038 | 1/1967 | O'Connell et al. | 4/172.19 |
| 3,416,165 | 12/1968 | Pereira | 4/172.19 |
| 3,440,780 | 4/1969 | Adam et al. | 52/169 |
| 3,736,599 | 6/1973 | Kessler et al. | 4/172.19 |
| 3,739,539 | 6/1973 | Posnick | 52/169 |
| 3,906,688 | 9/1975 | Witte | 248/351 |
| 3,975,874 | 8/1976 | Witte | 52/169 R |

*Primary Examiner*—Henry K. Artis
*Attorney, Agent, or Firm*—Steinberg & Blake

[57] ABSTRACT

A swimming pool having a panel composed in its entirety of a single unit of plastic and having an upright relatively thin wall an inner surface of which is directed toward the interior of the pool and an outer surface of which is directed away from the interior of the pool, this wall having at an upper region a stepped portion defining a recess extending along the upper region of the wall and directed toward the interior of the pool with the outer surface being stepped as well as the inner surface, and with this stepped portion being situated directly beneath a coping portion formed by a part of the wall which is curved first inwardly towrd the interior of the pool and then upwardly and outwardly away from the pool to form a coping portion which has a hollow inner interior part situated over the recess formed by the stepped portion. An elongated fastener strip is adapted to be received in the recess defined by the stepped portion for releasably fastening an upper edge of a liner sheet to the panel so as to extend downwardly from the recess along the inner surface of the panel.

28 Claims, 18 Drawing Figures

FIG. 3
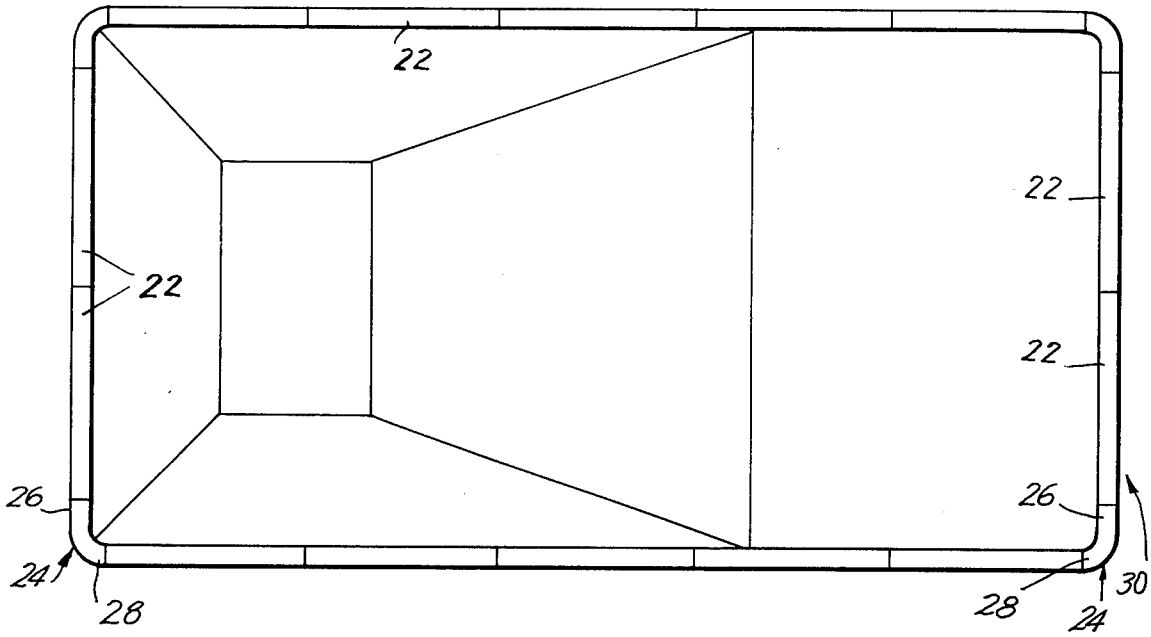
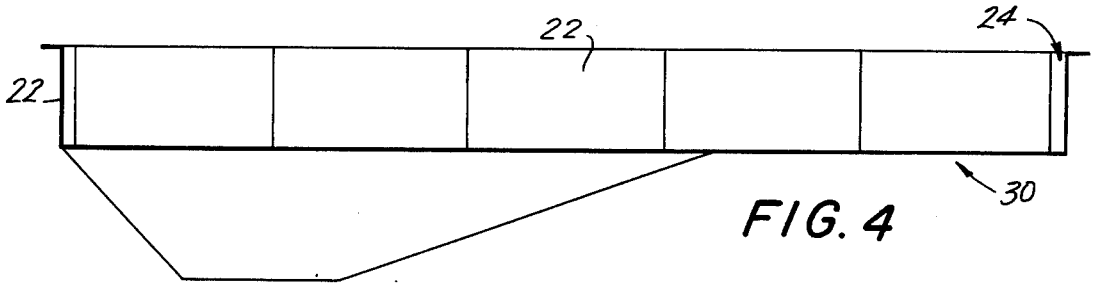
FIG. 4
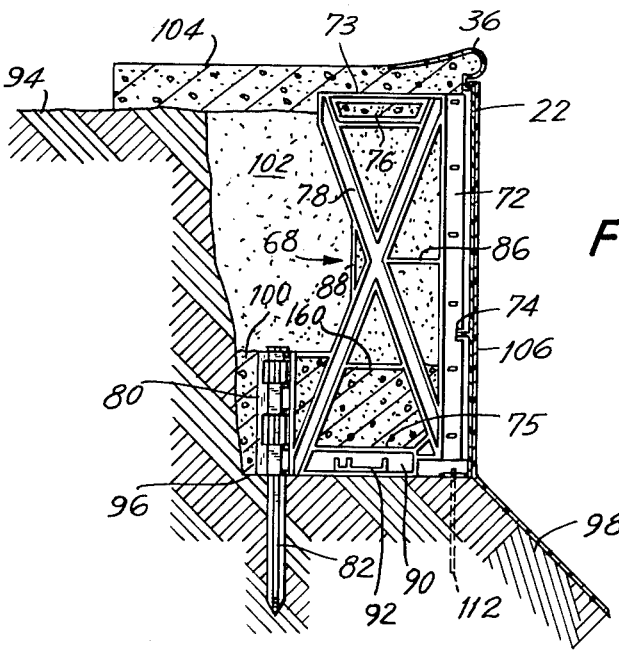
FIG. 6

120
36
122
38
40
128
32
34
44
42
132
130
134

36
54
124
56
38
50
48
32
44
50
42

36
120
118
122
116
114
38
32
40
34
44
126
42

38
114
134
136
130
106
32

SWIMMING POOL, AND COMPONENTS THEREOF

CROSS REFERENCE TO RELATED APPLICATION

This application is a continuation-in-part of copending application Ser. No. 428,882, filed Dec. 27, 1973, and now U.S. Pat. No. 3,938,199.

BACKGROUND OF THE INVENTION

The present invention relates to swimming pools.

In particular, the present invention relates to swimming pools as well as separate components thereof and methods for manufacturing such components.

At the present time, conventional swimming pools, particularly in-ground swimming pools, are relatively complex and expensive. Conventional swimming pools are made of materials such as metal, concrete, wood, in various combinations, and a large number of parts must be assembled together at the site of the pool as well as preliminarily manufactured before reaching the site of the pool, so that the structure itself is quite expensive as well as the labor involved in connection with manufacture of these components of the pool and installing the pool at the site.

Various attempts have been made to alleviate these problems, but up to the present time swimming pools are still extremely expensive. For example, it has already been proposed to manufacture a swimming pool from one-piece wall panels made of materials such as concrete or plastic, but these panels when they are made of concrete or plastic are very bulky and heavy and are expensive to manufacture and install. In addition to the disadvantages involved in such bulky heavy panels themselves, there are disadvantages involved in connection with the parts which are required to be assembled with such panels inasmuch as these panels are difficult to work with and difficult to assemble together with other components of the pool.

SUMMARY OF THE INVENTION

It is accordingly a primary object of the present invention to provide the possibility of greatly reducing the costs involved in connection with swimming pools, without in any way detracting from the quality thereof.

In particular, it is an object of the invention to provide for swimming pools wall panels which while composed of a single plastic unit are nevertheless extremely light and relatively inexpensive to manufacture and handle while at the same time having the required strength.

Furthermore it is an object of the present invention to provide panels of this type which can readily be assembled with other components of the pool at a cost which is far less than previously encountered costs.

In addition it is an object of the present invention to provide a method for manufacturing such a wall panel in such a way that the costs involved in the manufacturing process are reduced as compared to conventional costs.

Furthermore it is an object of the present invention to provide for a swimming pool corner panels all of which may have the same construction irrespective of the nature of the final pool.

An additional object of the present invention is to provide for swimming pools reinforcing frames which are extremely strong while at the same time being far less expensive to manufacture than conventional reinforcing frames.

Accordingly to the invention the swimming pool includes a standard panel formed of a single plastic unit and having a substantially upright relatively thin wall which at an upper region is stepped both at its inner surface which is directed toward the interior of the pool and its outer surface which is directed away from the interior of the pool to define along the inner surface of the panel a recess for receiving a fastener which fastens the upper edge of a plastic liner sheet to the pool to line the inner surface thereof. Just above this stepped portion the unitary wall panel has a portion extending first inwardly toward the interior of the pool and then curving around and outwardly away from the interior of the pool to form a coping portion, this coping portion having at its inner part an interior recess which is situated over the recess defined by the stepped portion. Panels of the above type are joined with corner panels which have legs of unequal lengths and which are of identical construction at their upper and lower regions so that the same corner panels can be used for different pools simply by inverting the corner panel. In addition, the pool of the invention includes a reinforcing frame means having a front upright portion adapted to be joined to a reinforcing fin of a wall panel with upper and lower horizontal portions extending rearwardly from the upright portion and with an X-shaped portion extending between and joined to the upper and lower portions. At a rear lower portion the reinforcing frame means has an upright vertically slotted part for receiving a stake. According to further features of the invention this stake is molded directly with the remainder of the reinforcing frame means. When a wall panel is molded, there is simultaneously molded therewith a fastener strip which thereafter is separated from the remainder of the panel and available for being assembled therewith to releasably hold an upper edge of a plastic liner sheet assembled with the wall panel.

BRIEF DESCRIPTION OF DRAWINGS

The invention is illustrated by way of example in the accompanying drawings which form part of this application and in which:

FIG. 3 is a schematic top plan view of a further embodiment of the pool according to the invention;

FIG. 4 is a schematic sectional elevation of the pool of FIG. 3;

FIG. 6 is a schematic sectional elevation of a finished pool according to the invention;

DESCRIPTION OF PREFERRED EMBODIMENTS

Figure 1:
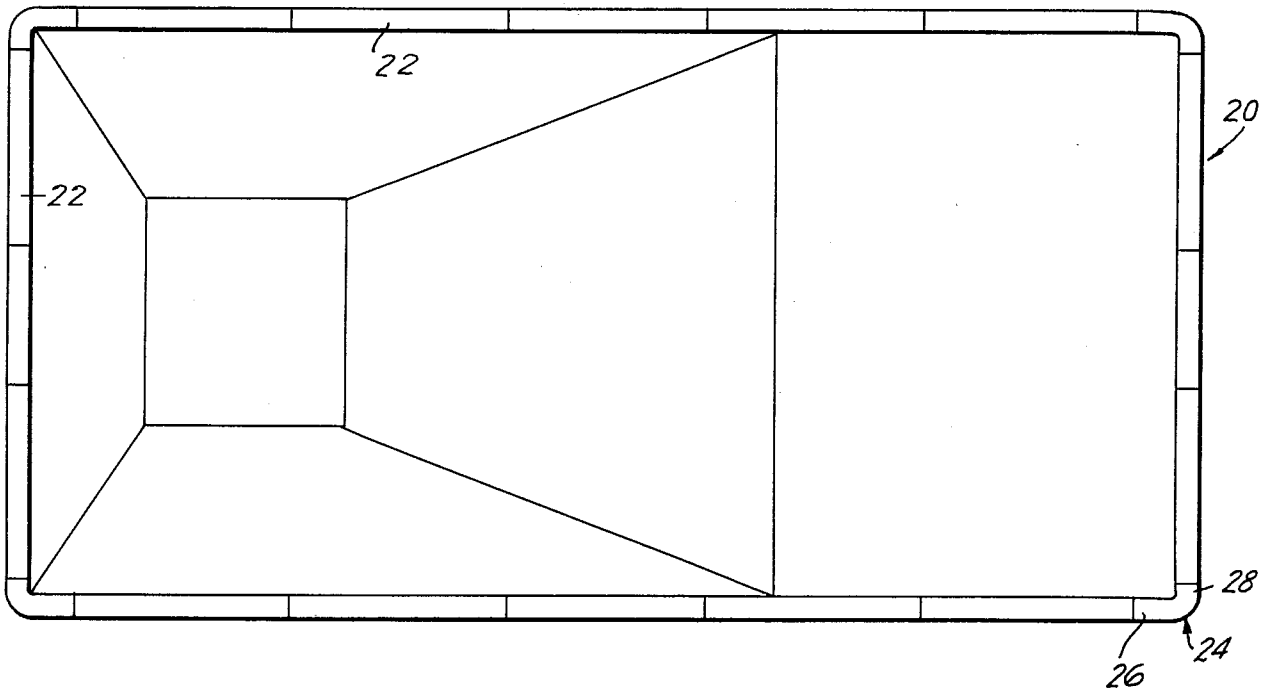
FIG. 1 is a schematic top plan view of one possible pool of the invention.
Figure 2:
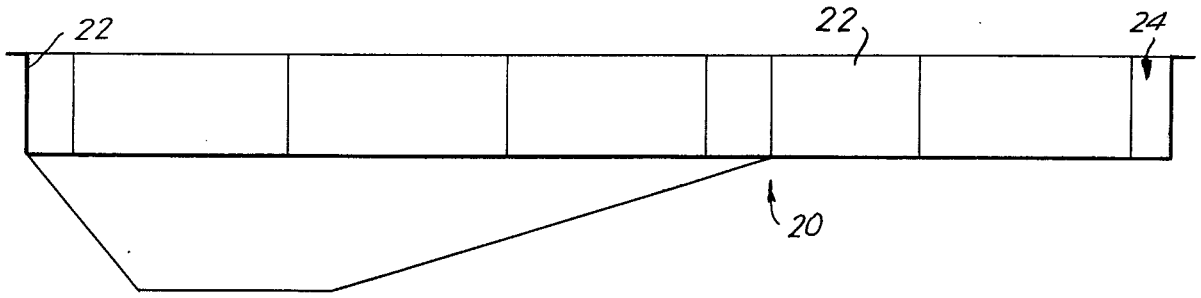
FIG. 2 is a schematic sectional elevation of the pool of FIG. 1.

Referring first to FIGS. 1 and 2, there is illustrated therein one possible pool according to the invention. The pool 20 of FIGS. 1 and 2 is made up of a series of identical wall panels 22, and the details of each wall panel 22 are described below. As is shown in FIG. 2, the pool 20 is shallow at its right portion and is deeper at its left portion, as viewed in FIGS. 1 and 2. The several wall panels 22 have a height equal to the depth of the shallow portion of the pool and are distributed along the straight sides and ends of the pool in the manner illustrated, the liner being omitted from the schematic illustration of FIG. 2 for the sake of showing how the several panels 22 are joined in end-to-end relation along the sides, as well as the ends of the pool. The sides and ends of the pool 20 are joined together by way of corner panels 24, and it will be noted that each corner panel 24 has a long leg 26 and a short leg 28, the illustrated corner panel being curved between the long and short legs 26 and 28 thereof. It will be noted from FIG. 1 that the corner panels 24 are arranged with their short legs adjoining the panels 22 at the shorter ends of the pool while the longer legs 26 of the corner panels 24 are joined with each series of panels 22 situated along the longer sides thereof.

Referring now to FIGS. 3 and 4, the pool 30 which is illustrated therein is made up of the very same straight wall panels 22 and corner panels 24 as the pool of FIGS. 1 and 2. However, in order to illustrate the variations possible with the straight and corner panels of the invention, it will be seen that the pool of FIGS. 3 and 4 includes five straight panels 22 at each of the longer sides thereof, rather than four such panels as shown in FIGS. 1 and 2. In addition, it will be seen that the corner panels 24 of FIGS. 3 and 4 are arranged differently than in FIGS. 1 and 2 in that the longer legs 26 thereof are joined to the pair of panels 22 at each end of the pool 30 while the shorter legs 28 are joined to the series of panels 22 which form each of the longer sides thereof. Of course, the plastic liner sheet for the pool of FIGS. 3 and 4 will be different from the plastic liner sheet of FIGS. 1 and 2, but the very same panels 22 and 24 are used, so that considerable variation is possible simply by changing the relationship between the corner panels and the straight panels as well as by altering the number of straight panels 22 which are used.

Figure 5:
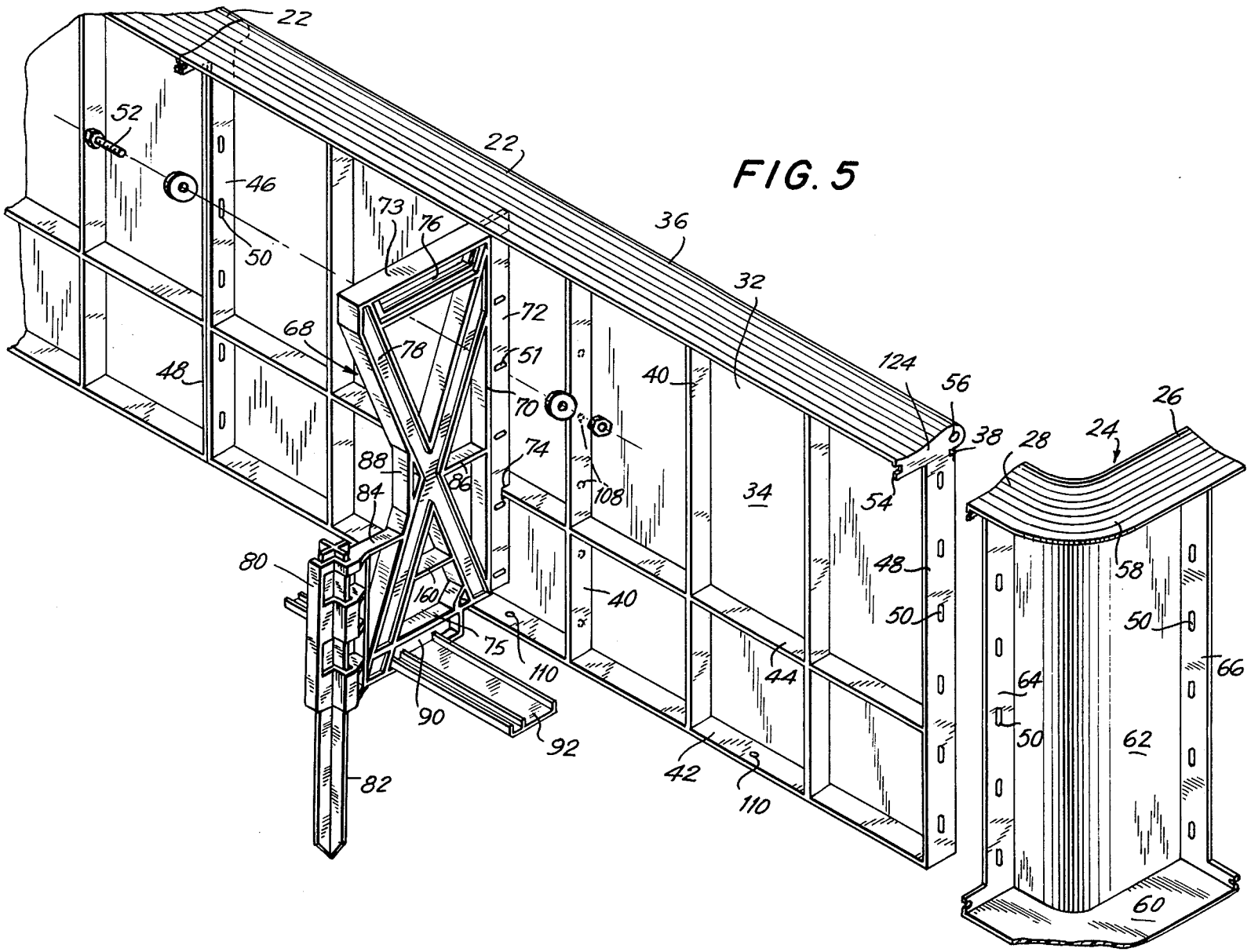
FIG. 5 is a fragmentary perspective illustration of part of a pool of the invention as it appears when looking toward the exterior of the panels thereof.

The structure which is fragmentarily illustrated in FIG. 5 is typical of the structure of a pool of the invention as illustrated in FIGS. 1-4 and is used along the sides and ends of the pool as well as a corner thereof, irrespective of the particular number of straight panels which are joined together in end-to-end relation to determine the length of a side or end of a pool. Thus, FIG. 5 shows a pair of panels 22 joined in end-to-end relation as well as a corner panel 24. These parts of the pool are shown as they appear when looking toward the outer surface of the components 22 and 24, this outer surface being directed away from the interior of the pool. Thus, each straight panel 22 has a predetermined length and includes a relatively thin upright wall 32 the outer surface 34 of which is visible in FIG. 5. The thin wall 32 is integrally formed with an upper coping portion 36, while between the coping portion 36 and the thin upright wall 32 there is a stepped portion 38 described in greater detail below. A plurality of reinforcing fins 40 are integrally formed with the wall 32 and extend rearwardly therefrom while being perpendicular thereto, these reinforcing fins 40 being distributed along each panel 22 and being oriented vertically in the finished pool. The several vertical fins 40 are integral with the coping portion 36 at a lower surface thereof and they are also integral with a longitudinally extending bottom wall 42 which projects rearwardly from and is integral with a lower edge of the vertical or upright wall 32 of the panel 22. An additional horizontal reinforcing fin 44 is formed integrally with the wall 32 and the upright fins 40, extending parallel to the bottom wall 42 between the fins 40 as is apparent from FIG. 5.

Each straight panel 22 also has integrally formed therewith a pair of opposed upright end walls 46 and 48, the end wall 46 of one panel being situated directly next to the end wall 48 of the next panel. These end walls 46 and 48 are also integrally formed with the remainder of the panel 22 and extend rearwardly or outwardly from the upright wall 32 at the opposed end edges thereof while also being integrally joined with and closing off the interior of the coping portion 36, as is apparent for the end wall 48 illustrated in FIG. 5. Of course the ends of the horizontal reinforcing fins 42 and 44 are integrally formed with the end walls 46 and 48. During the molding these end walls 46 and 48 are formed with elongated apertures 50 extending therethrough. The apertures 50 of an end wall 46, for example, are aligned with the apertures 50 of an abutting end wall 48 of the next panel, and suitable fastener bolts and nuts 52 extend through the several aligned apertures 50 of adjoining end walls 46 and 48 for fastening successive panels to each other. The upper outer portions of the end walls 46 and 48 are formed with notches 54, and these notches can also receive fastener bolts 52 with nuts connected thereto at the regions where a pair of end walls 46 and 48 butt against each other, or a reinforcing rod which becomes embedded in concrete may be situated in these notches if desired.

As is apparent from FIG. 5, the end wall 48 of each panel 22 is formed at its upper inner region in alignment with the coping portion 36 with a relatively shallow recess 56 of circular configuration. The opposed end wall 46 has at the upper forward region of the coping portion a projection which is received with a snug fit in the recess 56 so that in this way the successive panels are vertically aligned with each other.

FIG. 5 also illustrates one of the corner panels 24 which it will be noted has coping portions 58 and 60 at the top and bottom ends thereof with each of these coping portions being identical with the coping portion 36 so as to form an extension thereof. In the illustrated example the shorter leg 28 is to be joined to the right panel 22 shown in FIG. 5. The corner panel 24 has an upright relatively thin wall 62 of the same material as the upright wall 32 but curved as illustrated so as to form the short leg 28 and the long leg 26. At its end edges the wall 62 is formed integrally with a pair of end walls 64 and 66 similar to the end walls 46 and 48, and of course the end wall 64 will butt against the end wall 48 shown at the right of the right panel 22 in FIG. 5, with the end wall 64 being formed with apertures 50 identical with the apertures 50 of the right end wall 48 so that fastener means 52 can pass through the aligned apertures 50 for fastening the end wall 64 to the right end wall 48 shown in FIG. 5. In the same way the end wall 66 is formed with additional apertures 50 to be aligned with apertures of the end wall 46 of the next panel which is not shown in FIG. 5 and which forms a continuation of the longer leg 26 of the corner panel 24 shown in FIG. 5. The end wall 64 shown in FIG. 5 is integrally formed at its upper inner end region where the coping portion 58 is located with a plug or boss which is snugly received in the recess 56 which is shown in FIG. 5 so that the corner panel 24 of FIG. 5 will be properly aligned with the right panel 22 shown in FIG. 5. At the region of its lower inner portion the end wall 64 is formed with a recess similar to the recess 56 for receiving an aligning plug or boss of a panel in the event that the corner panel 24 is inverted from the orientation thereof shown in FIG. 5. The end wall 66 is in fact formed at its upper inner region in alignment with the coping portion 26 with a recess corresponding to the recess 56 for receiving the aligning boss of the next panel which forms a continuation of the longer leg 26 of the corner panel 24, and at its bottom inner region the end wall 66 has an unillustrated boss which would be received in the recess 56 shown in FIG. 5 in the event that the corner panel 24 of FIG. 5 were inverted.

According to a further feature of the invention, at least one pair of abutting walls 46 and 48 of at least one pair of straight panels 22 at each side and end of the pool is joined by fasteners 52 with a reinforcing frame means 68. This reinforcing frame means 68 is constructed of a single plastic unit in the same way as each straight panel 22 and corner panel 24. The reinforcing frame means 68 has an inner elongated upright portion 70 of substantially T-shaped cross section having a vertical wall portion 72 situated directly next to and in abutment with end wall 46, this wall 72 being formed with elongated horizontal apertures 51 to be aligned with apertures 50 formed in end walls 46 and 48 for fastening the reinforcing frame means thereto. It will be noted that the wall 72 is formed with a notch 74 for receiving the horizontal reinforcing fin 44. Integrally formed with the upright portion 70 are a pair of outwardly extending horizontal portions 73 and 75. The portion 73 is formed with an elongated horizontal opening 76 passing therethrough for receiving concrete so as to form a concrete lock for the upper concrete deck referred to below. Between the upper and lower horizontal arm portions 73 and 75 the frame means 68 includes a substantially X-shaped portion 78 joined integrally with the upper and lower portions 73 and 75 in the manner illustrated in FIG. 5. The outer portion of the lower reinforcing arm 75 is integrally formed with a vertically extending slotted part 80, and the slot which passes vertically through this part 80 receives a stake 82 as illustrated. Horizontally extending struts 84 and 86 as well as a vertically extending strut 88 are also formed integrally with the remaining structure of the frame means as illustrated. The lower arm 75 has a vertical wall portion 90 suitably slotted to receive an optional pod 92.

The manner in which the above structure is set up at the site of the pool is schematically illustrated in FIG. 6. Thus, the ground is suitably hollowed so as to form below the ground surface 94 a substantially horizontal ledge 96 at the inner end of which the ground is further hollowed out and covered with a layer of sand 98 on which the lower portion of the plastic liner rests in a conventional manner.

The several panels 22 and corner panels are set up on the inner region of the ledge 96 in the manner illustrated in FIG. 6, and then the frame means 68 is joined to selected panels as set forth above with the stake 82 driven into the ground in the manner illustrated in FIG. 6. Then a lower body of concrete 100 is applied on the ledge 96 up to approximately a depth reaching to the top end of the vertically slotted part 80 which receives the upper portion of the stake 82. Backfill 102 is then filled in up to the ground surface 94, and on the backfill 102 and the ground surface 94 a concrete deck 104 is poured. It will be seen that this deck forms an extension of the upper coping portion 36 filling the hollow interior thereof and covering the upper part of the frame means 68, while extending at least partly through the aperture 76 which forms the concrete lock as referred to above. A vinyl liner sheet 106 is applied in a known way at the interior surface of the pool, with the upper edge of this vinyl liner sheet being received in a recess formed in each straight panel 22 and corner panel 24 just beneath the coping portions thereof in a manner described in greater detail below.

It is to be noted that a reinforcing frame means 68 will be joined to each abutting pair of end walls 46 and 48 of a pair of abutting panels 22, as well as to the abutting end walls of a straight panel 22 and a corner panel 24. In addition, if further reinforcing frame means 68 are considered desirable, one of the intermediate fins 40 of a panel 22 will be drilled at the site of the pool with openings 108, as shown in phantom lines in one of the reinforcing fins 40 of the panel 22 shown in FIG. 5, so that at such an intermediate reinforcing fin 40 it is also possible to situate an additional reinforcing frame means 68.

It is furthermore to be noted that the bottom wall 42 of each panel is formed with a relatively small number of openings 110 passing therethrough, as shown in FIG. 5. When the panels 22 are set up at the site of the pool, elongated steel rods 112 or the like, one of which is shown in phantom lines in FIG. 6, are driven down through these openings 110 and project upwardly therefrom to a slight extent so as to further anchor the panels 22 in position.

The details of each wall panel 22 are further illustrated in FIGS. 7–11. Referring to FIGS. 7–11, it will be seen that the relatively thin wall 32 is stepped in the manner shown most clearly in FIG. 11 to form the stepped recess 38 where the top edge region of the liner sheet 106 is located. The several panels 22 as well as the corner panels 24 and in fact the reinforcing frame means 68 are preferably made of a high impact polystyrene foam inasmuch as this material has been found to have the required strength even though it is extremely thin providing relatively light but exceedingly strong components for the pool of the invention. For example the thickness of the wall 32 need only be on the order of ¼ inch. This thickness is only increased slightly at the stepped region forming the recess 38 and the lower curved part of the coping portion 36 just above the recess 38. Thus, the entire panel 22 is molded to have the construction shown in FIGS. 7–11, and simultaneously with the molding the wall 32 is stepped at its upper region to define the recess 38. The stepped portion is situated not only at the inner surface of each panel directed toward the interior of the pool but also at the outer surface thereof. The coping portion 36 has just above the recess 38 the forwardly extending part 114 which curves upwardly at the front 116 of each coping portion 36 and then extends rearwardly so as to define over the recess 38 a recess 118 in the interior of the coping portion 36. The upper surface of the coping portion 36 is provided with lonitudinally extending ridges 120 for providing increased friction for the feet of individuals using the pool. It will be noted that each fin 40 has an upper wider portion 122 which extends transversely through the entire width of the coping portion 36 in the manner shown most clearly in FIGS. 8 and 11. The high impact polystyrene foam material is preferred not only because of its strength and lightness but also because the exterior exposed surfaces are free of openings. The cells of the foamed material are situated only in the interior wall structure and not at the exterior surface thereof.

Figures 8, 10, 11, 12:
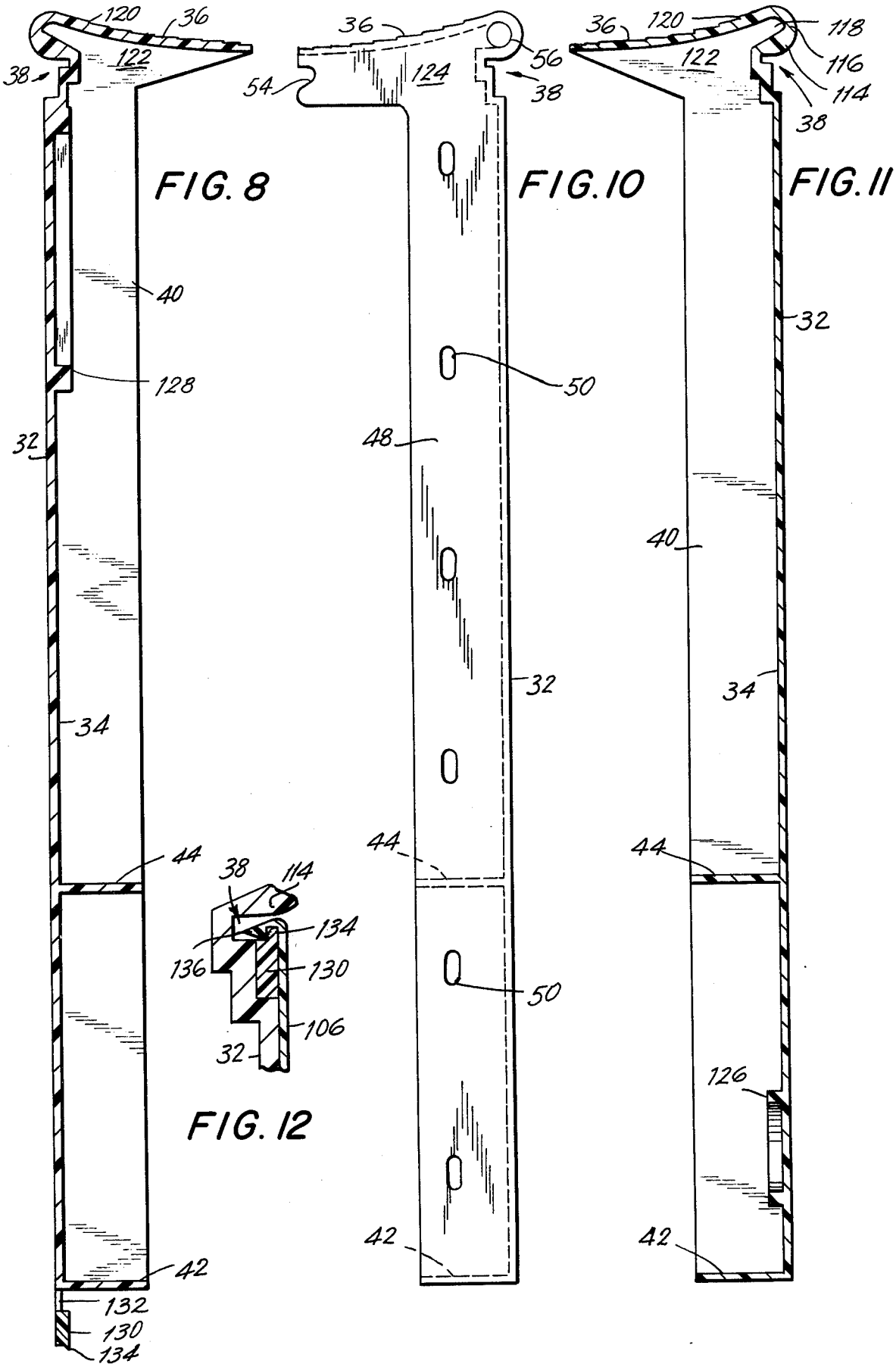
FIG. 8 is a sectional elevation of the panel of FIG. 7 taken along line 8—8 of FIG. 7 in the direction of the arrows.
FIG. 10 is an end elevation of the panel of FIG. 7 as seen when looking toward the right end of the panel of FIG. 7.
FIG. 11 is a sectional elevation of the panel of FIG. 7 taken along line 11—11 of FIG. 7 in the direction of the arrows.
FIG. 12 is a fragmentary sectional illustration of a part of the panel to which a plastic liner sheet is connected.

As is apparent particularly from FIG. 10, the end wall reinforcing fin 48 also has at its upper end the wider portion 124 which terminates at the rear in the notch 54 referred to above. Thus the end fins or walls 48 close off the hollow interior of the coping portion 36. The end wall 46 is a mirror image of the end wall 48 shown in FIG. 10.

Figure 7:
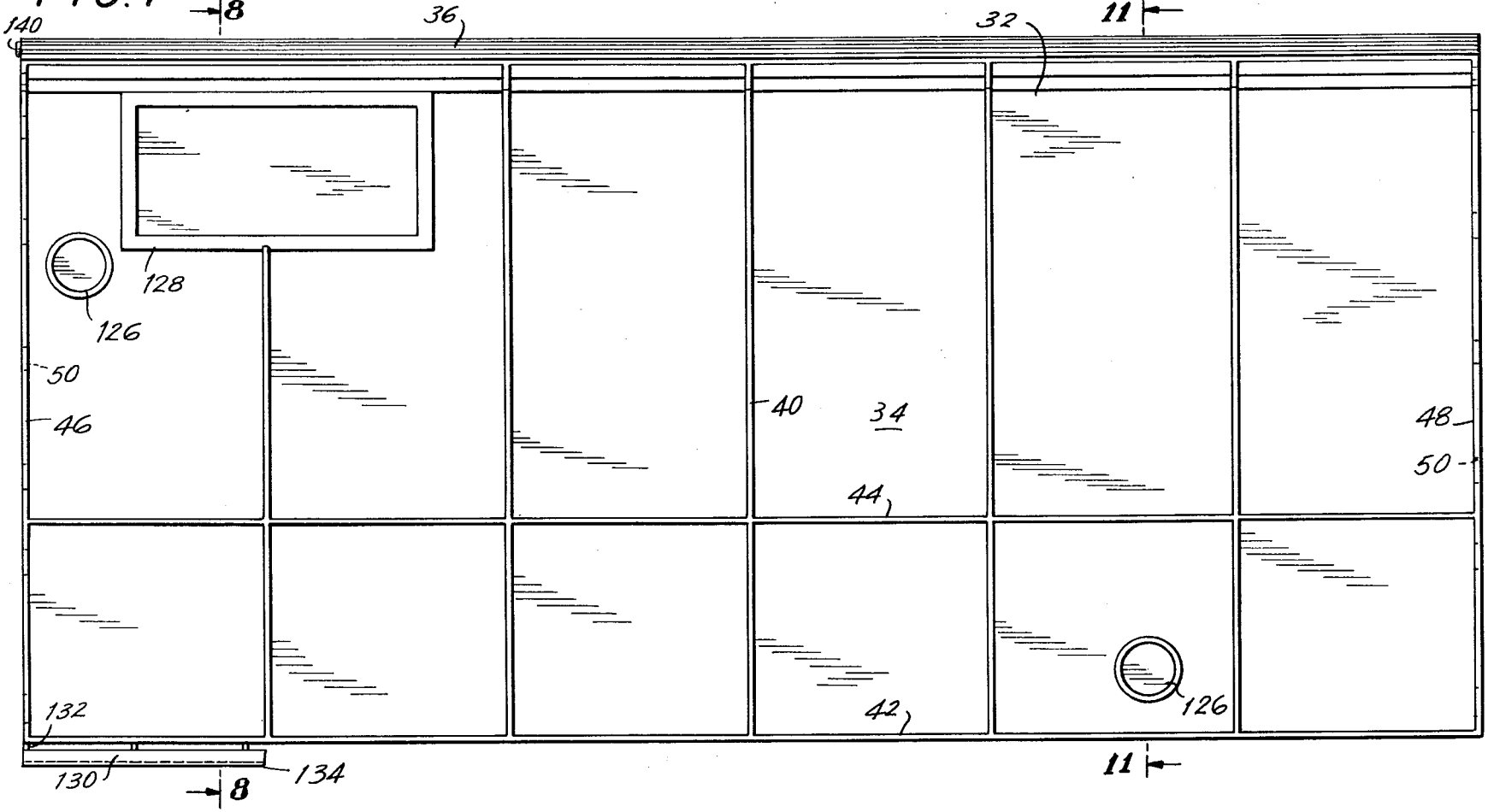
FIG. 7 is a fragmentary rear elevation of a panel forming part of a pool wall as it appears when looking toward the outer surface thereof which is directed away from the interior of the pool.
Figure 9:
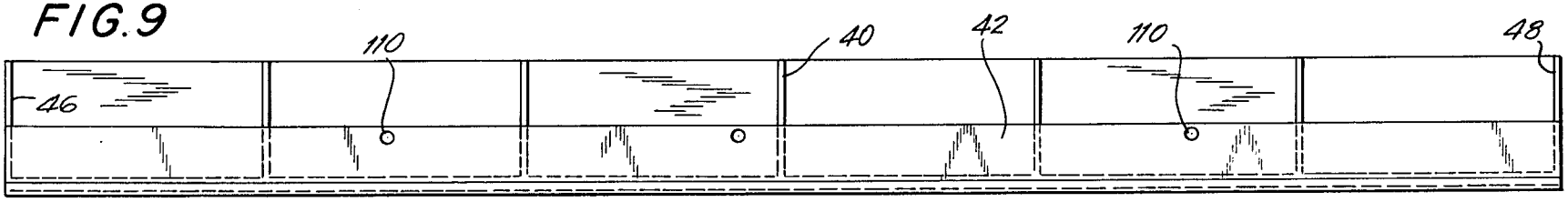
FIG. 9 is a bottom plan view of the panel of FIG. 7 as seen when looking upwardly toward the bottom of the panel of FIG. 7 with the fastener strip shown integrally molded to part of the panel in FIG. 7 being omitted from FIG. 9.

Simultaneously with the molding of the panels 22, there is molded therewith a pair of circular rearwardly extending ribs 126 and a rectangular endless rib 128, the latter being shown in FIGS. 7 and 8 while the lower right circular rib 126 of FIG. 7 is also illustrated in FIG. 11. These ribs determine portions which can be struck out of the wall 32 for the purpose of connecting pipes to the pool in the case of the circular ribs 126 or for the purpose of connecting a skimmer to a selected panel in the case that the part of the wall 32 surrounded by the rib 128 is removed.

Thus, an entire panel 122 is molded as a single unit having the construction described above and shown in particular in FIGS. 7–11.

In addition, according to a further feature of the invention, there is molded integrally with each panel 22 an elongated fastener strip 130. This strip 130 extends along the entire length of the panel and is molded adjacent the bottom wall 42 thereof. In the mold the strip 130 is molded integrally with the panel by way of fingers 132. This structure is most clearly apparent from the lower left portion of FIG. 7 as well as from the lower portion of FIG. 8. It will be noted particularly from FIG. 8 that the fastener strip 130 is substantially rectangular in cross section while having along one edge a lip 134.

After this structure has been removed from the mold, the fingers 132 are broken away from the bottom edge of the wall 32 and they are also broken away from the strip 130 so as to leave the latter as a separate fastener strip.

As is shown in FIG. 12, the cross-sectional dimension of the fastener strip 130 is such that it can be received in the lower stepped region of the recess 38, extending along the entire length of each panel. Thus, each fastener strip 130 is fastened as by way of a suitable adhesive to the stepped portion of each panel in the recess 38 thereof to provide a construction as shown in FIG. 12 where the lip 134 projects upwardly at a location just below the forwardly extending part 114 of the coping portion 36. The vinyl liner sheet 106 is provided at its upper edge with a thickened bead portion 136 having in cross section the configuration apparent from FIG. 12 so that this bead can be placed in the recess 38 behind the lip 134 to engage the latter and thus retain the upper edge of the sheet 106 in position in the manner indicated in FIG. 12.

While the bead 136 can easily be slipped behind the lip 134 when the pool is empty, the water filled into the pool pulls downwardly on the liner causing the bead to be engaged and held by the lip.

It is to be noted that the plastic material for the straight wall panels and for the corner panels can be manufactured in the manner disclosed in U.S. Pat. Nos. 3,268,636 or 3,436,446.

The recess 56 which appears at the upper right portion of the right panel 22 of FIG. 5 also appears at the upper right portion of the panel 22 shown in FIG. 7 and is apparent from the end view of FIG. 10. As is shown at the upper left portion of FIG. 7, the panel 22 has at the upper region of its end wall 46 a boss 140, and it is this boss which is received in the recess 56 of the adjoining panel for the purpose of lining the panels accurately with respect to each other. Thus, when looking toward the outer surface 34 of the wall 32 of each panel 22, the boss 140 is situated at the upper left and the recess 56 is situated at the upper right portion of each panel.

Figure 14:
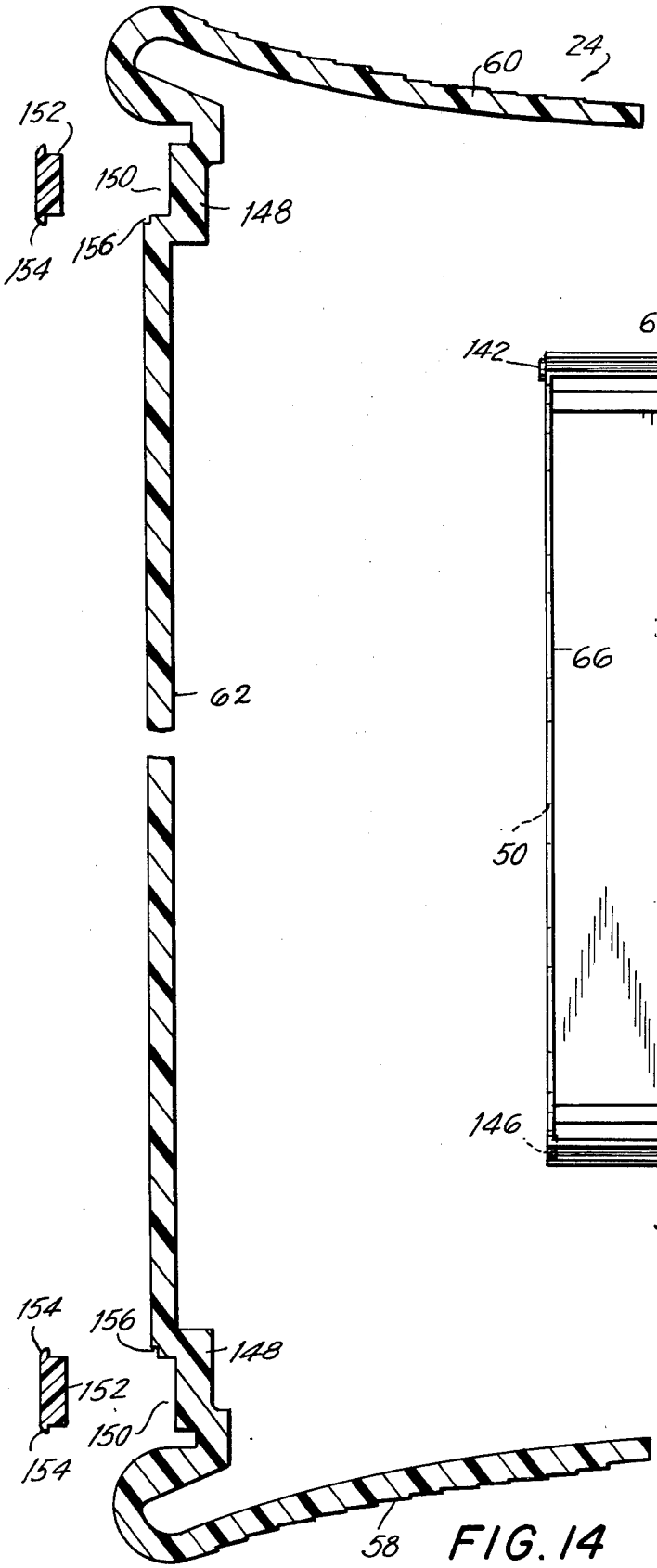
FIG. 14 is a partly exploded sectional elevation of a corner panel illustrating the configuration of the wall structure thereof.
Figure 13:
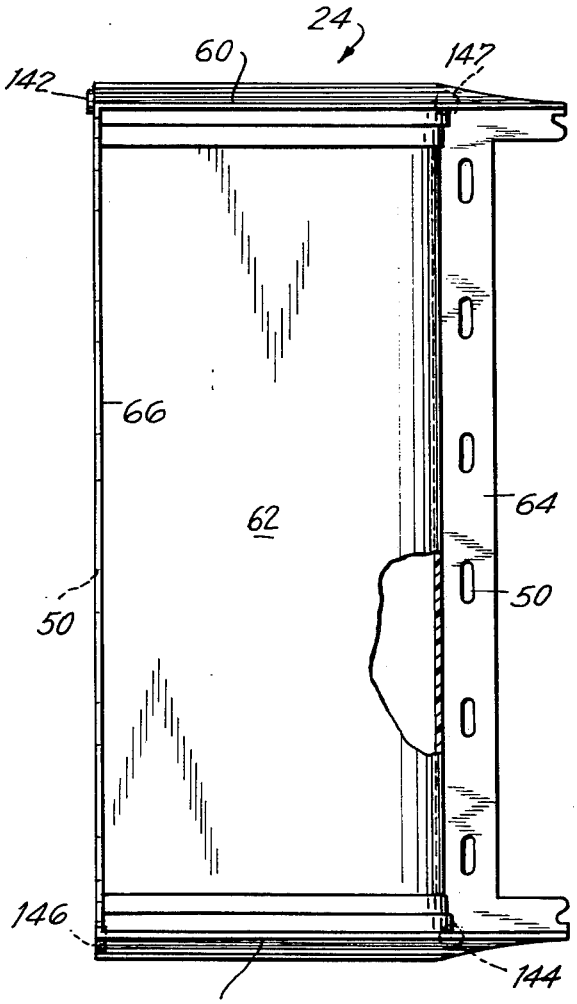
FIG. 13 is an elevation of a corner panel as seen when looking toward the exterior thereof which is directed away from the interior of the pool.

Referring now to FIGS. 13 and 14, the details of each corner panel 24 are illustrated therein. It will be noted that the corner panel 24 is shown in FIGS. 13 and 14 inverted with respect to the position thereof shown in FIG. 5 so that the coping portion 60 is situated at the upper part of the illustrated corner panel 24 in FIGS. 13 and 14. As is apparent from FIG. 13, at the upper end of the end wall 66 there is a projecting boss 142, and it is this boss which is received in the recess 56 of the end panel 22. Of course this boss 142 is situated at the lower right portion of the panel 24 as it is shown in FIG. 5. At the lower left portion of the panel 24 of FIG. 13 there is a recess 146 which is of the same construction as the recess 56 and which is situated at the upper right portion of the panel 24 in FIG. 5 to receive the boss 140 of the next panel 22 which is situated next to the panel 24 of FIG. 5 and connected to the wall 66 thereof. FIG. 13 shows at the lower right of the panel 24 therein a boss 144 which is the same size as the boss 142 and which is in fact the boss received in the recess 56 shown at the right end of the right panel 22 of FIG. 5. It is to be noted that the elongated openings 50 formed in the walls 64 and 66 at the ends of the corner panel 24 are situated so as to be substantially in alignment with the openings 50 of the adjoining end walls of the adjoining panels. The distribution of these openings 50 and the end walls 64 and 66 is however somewhat different from the distribution on the end walls of the straight panels 22 inasmuch as each panel 24 is somewhat longer than each panel 22, considered from top to bottom. In other words when the upper coping portion of a corner panel is aligned with the coping portion of the adjoining straight panels, the lower coping portion becomes situated at an elevation lower than the bottom end walls 42 of the adjoining panels. Thus FIG. 5 shows how the lower coping portion 60 of the panel 24 in FIG. 5 is situated at an elevation lower than the lower wall 42 of the illustrated panel 22. For example if the total height of each straight panel 22 is 44 inches then the total height of each corner panel 24 is 46 inches. In this way the boss 142 or 144 which is situated at the lower coping portion of the corner panel will become situated beneath the bottom wall of the adjoining panel so that the projecting boss will not prevent the adjoining end walls from being snugly joined one to the next.

Each corner panel 24 is molded as a single unit and has the details particularly apparent from FIG. 14. Thus it will be seen that each corner panel not only has the upper and lower coping portions but also has just beneath the interior recesses of the coping portions the opposed upper and lower stepped portions 148. It will be seen that these stepped portions have the same construction as the stepped portions of the straight panels and thus define elongated curved recesses 150 which are directed inwardly toward the interior of the pool.

When each corner panel 24 is molded, there is molded simultaneously therewith a pair of fastener strips 152 as indicated in FIG. 14. These fastener strips 152 are identical with the fastener strips 130 except that the strips 152 have lips 154, corresponding to the lips 134 but situated at each of the opposed longitudinal edges of each fastener strip 152. Of course, the fastener strips 152 are longitudinally curved so as to conform to the curvature of each corner panel 24. After being removed from the mold, the fastener strips 152 are adhered to the panel 24 in the recesses 150 thereof providing the equivalent of the structure shown in FIG. 12 for the purpose of attaching the upper edge of the liner sheet to the pool along the corners thereof as well as along the straight portions thereof. It will be noted that the recesses 150 are defined by an additional notch 156 to receive that one of the lips 154 which is directed away from the adjacent coping portion. Thus, each corner panel will always have at its upper region the structure for fastening part of the liner sheet thereto. At the lower region the strip 152 is joined with the corner panel so as to provide the latter with a smooth inner surface extending all the way down to the region of the lower coping portion so that in this way a smooth surface will be provided for the part of the liner sheet which is adjacent the lower recess 150 of a panel 24.

It is to be noted from FIG. 13 that the panel 24 has at the end thereof opposite to the boss 142, at the same end as the boss 142, a recess 147 corresponding to the recess 146 and of course receiving a boss of an adjoining panel when the recess 147 is situated together with the boss 142 at the upper part of the coping portion.

Furthermore, it is to be noted that the thickness of the wall of the corner panel may be made somewhat greater than the thickness of the wall of each straight panel. For example where each straight panel 22 has a wall 32 the thickness of which is on the order of ¼ inch, each corner panel can have a wall the thickness of which is on the order of ⅜ inch, so that in this way added strength is given to the pool wall structure at the region of the corners thereof.

Figure 15:
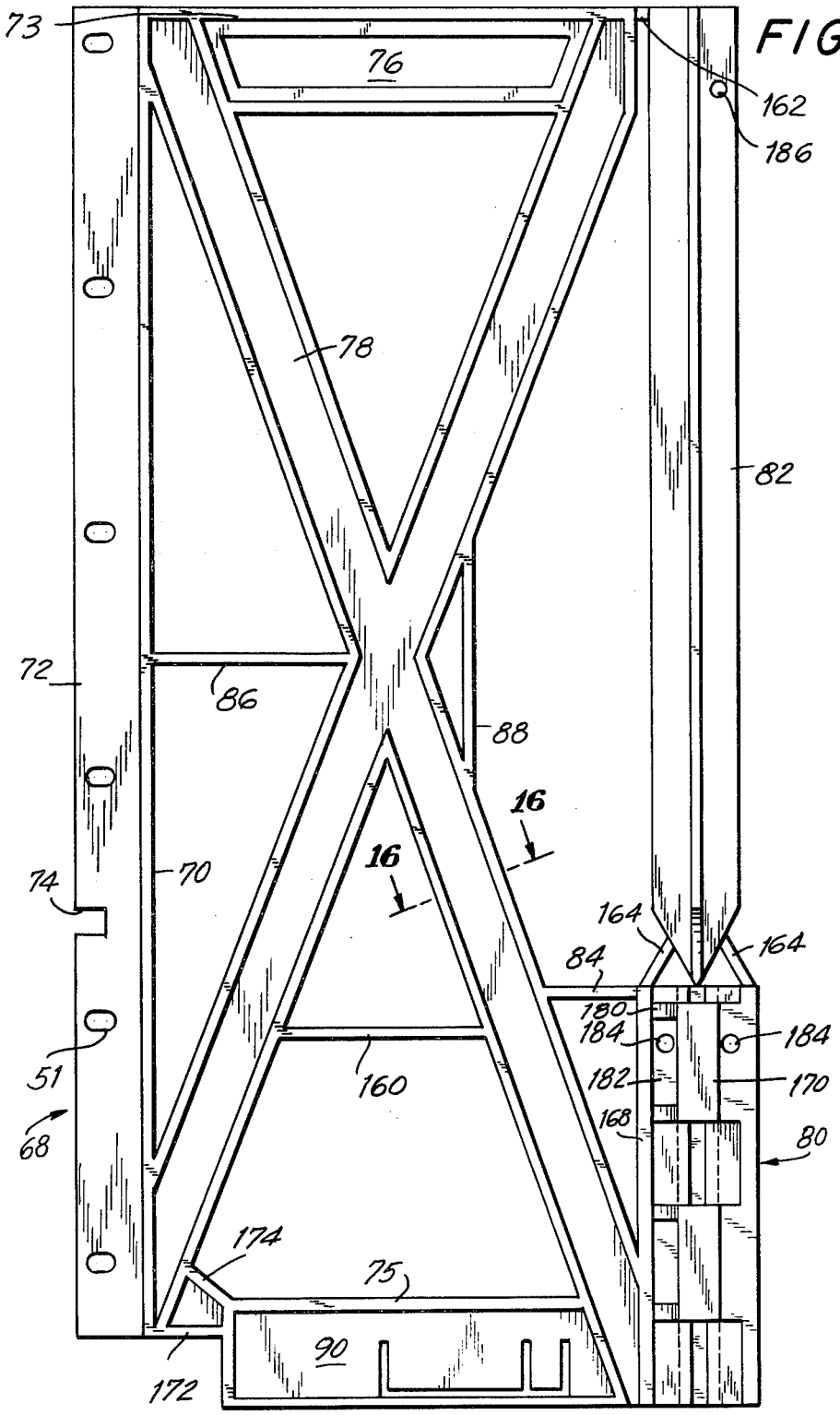
FIG. 15 shows in elevation a reinforcing frame means of the invention as it appears when removed from a mold.
Figure 16:
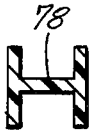
FIG. 16 is a sectional view of part of the frame means of FIG. 15 taken along line 16—16 of FIG. 15 in the direction of the arrows.

Referring now to FIGS. 15–18, the details of the reinforcing frame means 68 are illustrated therein. Thus, as is apparent from FIGS. 15 and 17, the front elongated portion 70 which is joined to the abutting walls 46 and 48 of a pair of straight panels 22 is of a T-shaped cross section and is molded not only with the elongated horizontally oriented opening 51 but also with the notch 74 which is provided to receive the reinforcing fin 44, as described above. The configuration of the opening 76 in the upper rearwardly extending arm 73 which forms the concrete lock is also clearly apparent from FIG. 15. Moreover FIG. 16 illustrates the H-shaped cross section of the arms of the X-shaped portion 78 which extends between the upper and lower rearwardly extending arms 73 and 75. FIG. 15 of course shows the reinforcing struts 84, 86, and 88. Also FIG. 15 shows an additional reinforcing strut 160 extending between the lower arms of the X-shaped reinforcing structure 78. Also the lower arm portion 90 is shown formed with the slots which receive the optional pod 92. It is furthermore to be noted that between the front vertical arm 70 and the lower rearwardly extending arm 75 there is a connecting wall structure formed by a lower horizontal wall 172 and an upper inclined wall 174, so that a strong connection is provided between the lower end of the vertical arm 70 and the horizontal arm 75.

In accordance with one of the further features of the present invention, the stake 82 is molded directly with the remainder of the reinforcing frame means 68. FIG. 15 shows the structure in the condition it has when removed from the mold. Thus, it will be seen that the top end of the stake 82 is molded directly with the upper arm 73, being connected thereto by way of a relatively short finger 162. As is apparent from FIG. 17 as well as FIG. 5, the stake 82 which is of a X-shaped cross section, is in position to be received in the slot therebeneath. Similar fingers 164 are molded directly with the lower pointed end of the stake 82 and the upper end of the rear slotted portion 80. Thus, after the structure is removed from the mold it is only necessary to break away from the fingers 162 and 164 so as to disconnect the stake 82 and permit it to be driven down through the portion 80 which is formed with a slot matching the configuration of the cross section of the stake 82.

Figure 18:
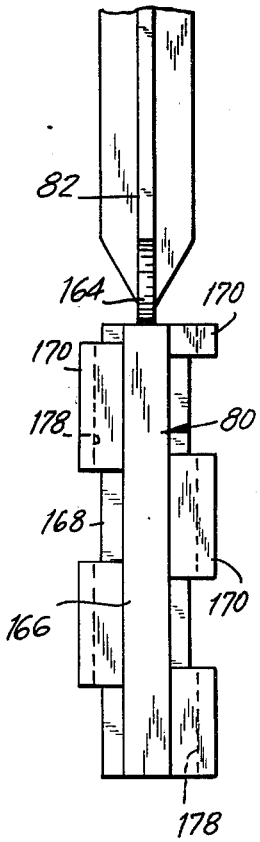
FIG. 18 is a rear elevation of the lower portion of the frame means of FIG. 15 showing that part of the frame means which receives a stake.
Figure 17:
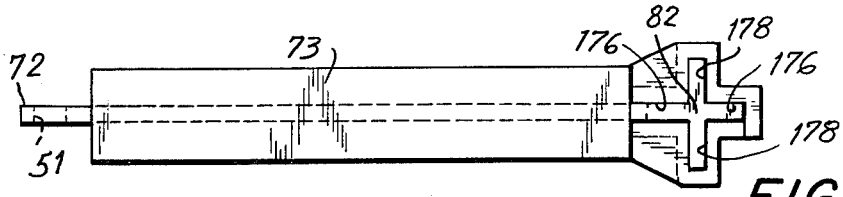
FIG. 17 is a top plan view of the frame means of FIG. 15.

As is apparent from FIG. 18, the slotted portion 80 has at its rear an elongated vertically extending wall 166 and at its front portion an elongated vertically extending wall 168 which is wider than the wall 166 and which is integrally joined at its top end to the rear end of the horizontal reinforcing rib 84. Between these rear and front wall portions 166 and 168 the rear slotted portion 80 has the laterally extending portions 170 which alternately extend laterally with respect to the wall 166 in opposite directions as illustrated in FIG. 18. These lateral portions 170 are spaced from each other by the portion 176 of the slotted structure which is situated in the same plane as the wall 72. Thus, each of the laterally extending portions 170 need only be formed with a laterally extending slot 178. In addition, each of these laterally extending portions 170 has only a relatively thin wall structure including for the upper left portion 170 of FIG. 18, for example, the upper and lower bracing substantially triangular walls 180 which project outwardly from a side wall 182. Thus the wall structure of the slotted portion 80 conforms in its configuration to the configuration of the slots passing through the portion 180, thus reducing the weight of the structure in this way.

The upper part of the slotted wall structure is formed with openings 184 passing therethrough, and some of these openings, either the front set or the rear set, are aligned with the opening 186 which is formed in the stake, so that a suitable pin can be passed through the aligned openings 184 and 186 for fixing the stake to the slotted structure 80 after the stake has been driven down through the slotted structure 80 to the required depth.

It is emphasized that all of the above details of the reinforcing frame means 68 are molded directly therein so that substantially no further operations are required on the reinforcing frame means after it is removed from the mold.

It is therefore apparent from the above description that with the structure of the invention extremely lightweight but strong pool components are molded substantially in their complete form so that with few if any exceptions it is possible to take the components as they come out of the mold and assemble them at the site of the pool without any further operations being required. The thin-walled structure of the components of the pool of the invention renders these components extremely light and easy to handle. At the same time, experience has demonstrated that these components do indeed have more than the required strength so that they are completely reliable during use. Because a relatively small number of identical components are molded for the pool of the invention, the number of molds required is relatively small and at the same time large numbers of identical components can be derived at relatively low cost from each mold, so that the total cost of the structure required for a pool in accordance with the invention is extremely low.

What is claimed is:

1. In a swimming pool, a panel for forming part of a wall of the pool, said panel being composed in its entirety of a single unit of plastic material, and said panel having a relatively thin upright wall which has an inner surface directed toward the interior of the pool and adapted to be engaged by a plastic liner as well as an outer surface which is directed away from the interior of the pool, said wall extending upwardly from a lower edge of said panel and said wall having at an upper region of said panel a portion curving inwardly toward the interior of the pool then upwardly and outwardly away from the pool to form a coping portion at the upper end region of the panel, and said wall being stepped outwardly away from the pool at an upper region next to but situated directly beneath said coping portion and an upper edge region of the upright portion of the pool wall to define beneath the coping portion a recess for receiving an upper edge of a liner sheet as well as a fastening means therefor, and fastening means joined with the panel at the recess defined by the stepped portion thereof for fastening the upper edge of a liner to the panel, said fastening means being in the form of an elongated strip of the same material as said panel and said stepped portion defining just beneath said coping portion a groove directed toward the interior of said pool, said strip having an upper lip aligned with said groove but spaced from the coping portion so that a part of a liner sheet which is thicker than the remainder thereof may be aligned with said groove and situated behind said lip to be held thereby in a condition assembled with the panel.

2. The combination of claim 1 and wherein the stepped portion of said wall just beneath said coping portion thereof includes steps at the outer as well as the inner surface of said wall while said coping portion where it extends just above the stepped portion first inwardly toward the interior of the pool and then around to continue at an upper part outwardly away from the pool forms an interior groove of the coping portion which is situated over the recess defined by the stepped portion of the wall at its inner surface so that the relative thinness of the wall is continued through the stepped portion and coping portion thereof.

3. The combination of claim 1 and wherein said panel is made in its entirety of a high impact polystyrene foam having a smooth exterior surface while having a foamed interior.

4. The combination of claim 2 and wherein a plurality of upright reinforcing fins are formed integrally with the upright wall and extend rearwardly from the outer surface thereof while being distributed therealong, said reinforcing fins each extending completely across the interior of said coping portion and being integral with the stepped portion as well as with the remainder of the upright wall of the panel.

5. The combination of claim 4 and wherein said reinforcing fins have a substantially uniform width up to approximately the elevation of said stepped portion and then are wider upwardly from said stepped portion where said fins are integrally formed with the coping portion.

6. The combination of claim 5 and wherein each panel has a bottom wall extending rearwardly from a lower edge of said upright wall thereof and integrally joined with bottom ends of said reinforcing fins.

7. The combination of claim 6 and wherein each panel has above said bottom wall a longitudinally extending substantially horizontal additional reinforcing fin situated at an elevation substantially lower than said stepped portion, extending substantially parallel to said bottom wall portion, and being integral with and extending across spaces defined between the vertical reinforcing fins.

8. The combination of claim 1 and wherein said upright wall of said panel has at its outer surface at least one endless rib integral with and projecting from said outer surface for defining a location where an opening may be formed through the upright wall in accordance with the configuration of said endless rib.

9. The combination of claim 1 and wherein the panel has at opposed ends a pair of upright end walls extending rearwardly from said upright wall, being substantially perpendicular thereto, and having upper portions which close off the interior of the coping portion.

10. The combination of claim 9 and wherein one of said upright walls is formed at a front region of the coping portion with a projecting plug while the other of the end walls is formed at a forward part of the coping portion with a recess the size of which matches that of the plug, so that a series of said panels can be situated in end to end relation with alignment therebetween being controlled by the plug at the end of one panel being received in said recess at the end of the next panel.

11. The combination of claim 9 and wherein said end walls are each formed with a plurality of openings passing therethrough and distributed longitudinally therealong so that fastening elements may be passed through said openings for fastening one panel to the next.

12. The combination of claim 1 and wherein said fastener strip when joined with the panel has an inner surface forming a continuation of the inner surface of the upright wall of the panel.

13. The combination of claim 1 and wherein a plastic liner is located next to the inner surface of said upright panel wall and has at its upper end a substantially hook-shaped portion engaged behind said lip of said fastener strip.

14. The combination of claim 13 and wherein said fastener strip is adhered to said panel in said recess formed by said stepped portion thereof.

15. For use in a swimming pool, a panel for forming at least part of a wall of the swimming pool, said panel being composed in its entirety of a single plastic unit made up for the most part of a relatively thin wall one surface of which is adapted to be directed toward the interior of the pool and the other surface of which is adapted to be directed toward the exterior of the pool, and the panel having at an upper edge of said relatively thin wall a stepped portion which is stepped at both of said surfaces and which forms a recess at said one surface, and just above said stepped portion said panel having a portion extending first over said recess then being curved upwardly and around and outwardly beyond said other surface of said panel to form a coping portion, said relatively thin wall having an elongated free edge region distant from said stepped portion and being formed integrally with a plurality of fingers projecting from said free edge region, said fingers being integrally formed with an elongated fastener strip adapted to be received in said recess and fastened therein for releasably holding a plastic liner sheet in engagement with the panel and extending along said one surface thereof, so that said fingers may be broken away to provide the fastener strip as a separate unit which may then be joined to the stepped portion in said recess defined thereby.

16. The combination of claim 1 and wherein a corner panel for forming a corner of the pool is joined in end-to-end relation with said first-mentioned panel, said corner panel having a pair of legs one of which is longer than the other, and said corner panel having top and bottom end regions each of which is of the same cross section as the region of said first-mentioned panel which has said stepped portion and coping portion.

17. The combination of claim 16 and wherein said panels respectively have end walls butting against each other and fastened together, said end walls respectively having surfaces directed toward and engaging each other, and one of said surfaces being formed with a recess while the other of said surfaces carries a projection received in said recess for aligning said panels with respect to each other.

18. The combination of claim 16 and wherein said corner panel has a curved portion situated between said legs thereof.

19. In a swimming pool, a panel for forming part of a wall of the pool, said panel being composed in its entirety of a single unit of plastic material, and said panel having a relatively thin upright wall which has an inner surface directed toward the interior of the pool and adapted to be engaged by a plastic liner as well as an outer surface which is directed away from the interior of the pool, said wall extending upwardly from a lower edge of said panel and said wall having at an upper region of said panel a portion curving inwardly toward the interior of the pool then upwardly and outwardly away from the pool to form a coping at the upper end region of the panel, and said wall being stepped outwardly away from the pool at an upper region next to but situated directly beneath said coping portion and an upper edge region of the upright portion of the pool wall to define beneath the coping portion a recess for receiving an upper edge of a liner sheet as well as a fastening means therefor, said panel having at least one fin formed integrally with said upright wall of said panel at said outer surface thereof and extending rearwardly from said outer surface and being substantially upright, and a reinforcing frame means fixed to said fin and extending outwardly therefrom substantially perpendicularly with respect to said upright wall of said panel, said reinforcing frame means terminating distant from said fin in a lower substantially elongated upright part formed with a slot extending vertically therethrough, and a stake extending into said slot and downwardly beyond the latter to be received in the earth.

20. The combination of claim 19 and wherein said frame means has upper and lower elongated substantially horizontal arms and between said arms a substantially X-shaped portion adjoined with said arms.

21. The combination of claim 20 and wherein a concrete deck is situated at the region of said upper horizontal arm of said frame means and extends rearwardly therefrom as well as over said upright horizontal arms and into said coping portion.

22. The combination of claim 21 and wherein backfill is situated beneath said concrete deck and around said frame means.

23. The combination of claim 22 and wherein a body of concrete is situated at the lower region of said frame means extending rearwardly from said panel at least approximately up to the elevation of the top end of said slotted rear portion which receives said stake, with the backfill being situated between the lower body of concrete and the upper concrete deck.

24. The combination of claim 21 and wherein at least the upper horizontal arm of said frame means is formed with an elongated opening passing therethrough to receive part of the concrete of the deck.

25. For use in a swimming pool, a reinforcing frame having a front upright portion adapted to be fastened with a panel of the swimming pool, and said frame having upper and lower rearwardly extending horizontal portions extending rearwardly from said front upright portion, said frame having between said upper and lower substantially horizontal portions thereof a portion of substantially X-shaped configuration, and all of said portions of said frame being integrally joined together, said frame fixedly carrying at the rear of the lower horizontal portion thereof a substantially upright part formed with a slot passing therethrough for receiving a stake.

26. The combination of claim 25 and wherein said stake is situated over said slotted portion, said frame having fingers integrally joining said stake with the upper horizontal portion and with the rear part so that said fingers may be broken away to release said stake so that the latter may be driven down through the rear slotted part of the frame.

27. The combination of claim 26 and wherein the rear slotted part of the frame has successive sections situated one above the other and each extending alternately in opposite lateral directions for receiving part of the stake.

28. For use in a swimming pool, a reinforcing frame having a front upright portion adapted to be fastened with a panel of the swimming pool, and said frame having upper and lower rearwardly extending horizontal portions, extending rearwardly from said front upright portion, said frame having between said upper and lower substantially horizontal portions thereof a portion of substantially X-shaped configuration, said portions of said frame being integrally joined together, a substantially upright part formed with a slot passing therethrough for receiving a stake fixedly carried by said frame, said stake situated over said slotted portion, said frame having fingers integrally joining said stake with the upper horizontal portion and with the rear part so that said fingers may be broken away to release said stake so that the latter may be driven down through the rear slotted part of the frame.

* * * * *